US011330890B2

(12) United States Patent
Trochel

(10) Patent No.: US 11,330,890 B2
(45) Date of Patent: May 17, 2022

(54) DISPENSING ASSEMBLY FOR COSMETIC PRODUCT, HAVING A CARTRIDGE AND A TRANSMISSION ELEMENT CONFIGURED TO BE DETACHABLY COUPLED

(71) Applicant: AXILONE PLASTIQUE, Auray (FR)

(72) Inventor: Reynald Trochel, Plouharnel (FR)

(73) Assignee: AXILONE PLASTIQUE, Auray (FR)

( * ) Notice: Subject to any disclaimer, the term of this patent is extended or adjusted under 35 U.S.C. 154(b) by 49 days.

(21) Appl. No.: 16/772,378

(22) PCT Filed: Dec. 10, 2018

(86) PCT No.: PCT/FR2018/053169
§ 371 (c)(1),
(2) Date: Jun. 12, 2020

(87) PCT Pub. No.: WO2019/115924
PCT Pub. Date: Jun. 20, 2019

(65) Prior Publication Data

US 2021/0076803 A1 Mar. 18, 2021

(30) Foreign Application Priority Data

Dec. 12, 2017 (FR) ..... 17 62015

(51) Int. Cl.
*B43K 21/08* (2006.01)
*A45D 40/06* (2006.01)
(Continued)

(52) U.S. Cl.
CPC ..... *A45D 40/06* (2013.01); *A45D 40/16* (2013.01); *A45D 2040/0025* (2013.01); *A45D 2040/0037* (2013.01)

(58) Field of Classification Search
CPC ..... A45D 40/06; A45D 40/16; A45D 2040/0025; A45D 2040/0037
See application file for complete search history.

(56) References Cited

U.S. PATENT DOCUMENTS 3,623,821 A 11/1971 Gould et al.
4,505,607 A 3/1985 Sugiyama
(Continued)

FOREIGN PATENT DOCUMENTS

CN 203234222 U 10/2013
FR 1118520 A 6/1956
(Continued)

OTHER PUBLICATIONS

International Search Report, dated Mar. 29, 2019, from corresponding PCT application No. PCT/FR2018/053169.
(Continued)

*Primary Examiner* — Jennifer C Chiang
(74) *Attorney, Agent, or Firm* — Nixon & Vanderhye

(57) ABSTRACT

The cosmetic product dispensing assembly includes a transmission element, a tubular cartridge of cosmetic product, configured to be detachably coupled to the transmission element, a receiving shell capable of receiving the transmission element. The cartridge includes a receptacle for cosmetic product engaging with the helical groove of an outer tube and the longitudinal guide slot of the control sleeve, and a bottom element integral in rotation with the control sleeve. The transmission element is configured to be received and non-detachably held in the receiving shell, and includes a snap-in element on an inner face.

20 Claims, 4 Drawing Sheets

(51) Int. Cl.
*A45D 40/16* (2006.01)
*A45D 40/00* (2006.01)

(56) References Cited

U.S. PATENT DOCUMENTS

| | | | | |
|---|---|---|---|---|
| 5,605,408 | A | 2/1997 | Su | |
| 6,116,801 | A * | 9/2000 | Patel | A45D 40/06 401/78 |
| 6,293,391 | B1 | 9/2001 | Kim | |
| 8,556,527 | B1 | 10/2013 | Chou | |
| 10,881,184 | B1 * | 1/2021 | Yan | A45D 40/06 |
| 2010/0078344 | A1 | 4/2010 | Martins et al. | |
| 2013/0022384 | A1 | 1/2013 | Yan | |
| 2017/0196339 | A1 * | 7/2017 | Kim | A45D 40/065 |

FOREIGN PATENT DOCUMENTS

| | | | |
|---|---|---|---|
| FR | 2502471 | A1 | 10/1982 |
| FR | 2942115 | A1 | 8/2010 |
| GB | 2183220 | A | 6/1987 |
| JP | S57-155712 | U | 9/1982 |
| JP | S60-173226 | U | 11/1985 |
| JP | S63-068917 | U | 5/1988 |
| JP | 2013-517017 | A | 5/2013 |
| JP | 2013-172888 | A | 9/2013 |
| KR | 10-2000-0012473 | A | 3/2000 |
| KR | 10-2004-0034228 | A | 4/2004 |
| WO | 2011/085511 | A1 | 7/2011 |
| WO | 2016/011631 | A1 | 1/2016 |

OTHER PUBLICATIONS

French Search Report, dated Jul. 4, 2018, from corresponding French application No. 1762015.
French Search Report, dated Jun. 26, 2018, from French Application No. 1762012, cited in related U.S. Appl. No. 16/772,088.
French Search Report, dated Jun. 29, 2018, from French Application No. 1762013, cited in related U.S. Appl. No. 16/772,347.
International Search Report, dated Mar. 22, 2019, from PCT Application No. PCT/FR2018/053167, cited in related U.S. Appl. No. 16/772,088.
International Search Report, dated Mar. 22, 2019, from PCT Application No. PCT/FR2018/053168, cited in related U.S. Appl. No. 16/772,347.
Office Action issued in Korean Patent Application No. 10-2020-7019615 dated Aug. 30, 2021.
Office Action issued in Japanese Patent Application No. 2020-531914 dated Oct. 4, 2021.
Office Action issued in the co-pending U.S. Appl. No. 16/772,347 dated Oct. 28, 2021.
Office Action issued in Japanese Patent Application No. 2020-531942 dated Oct. 11, 2021.
Office Action issued in Japanese Patent Application No. 2020-531907 dated Nov. 1, 2021.

* cited by examiner

DISPENSING ASSEMBLY FOR COSMETIC PRODUCT, HAVING A CARTRIDGE AND A TRANSMISSION ELEMENT CONFIGURED TO BE DETACHABLY COUPLED

FIELD OF THE INVENTION

The invention relates to containers for cosmetic products. More specifically, the invention relates to cosmetic product dispensing assemblies which comprise a base and a tubular cartridge configured to be detachably coupled to each other. The invention relates in particular to lipstick dispensing assemblies.

TECHNOLOGICAL BACKGROUND OF THE INVENTION

A cosmetic product dispensing assembly may comprise a base, a cartridge capable of being coupled to the base, and other parts such as a complementary cap for the cartridge which serves to prevent access to the cosmetic product. This is often the case with lipstick dispensing assemblies. The cartridge then serves to enclose a stick of lipstick and allow access to it. To achieve this, the cartridge comprises a receptacle for the stick of lipstick. The function of the base is, among other things, to enable gripping the lipstick dispensing assembly. When the assembly comprising the base and the cartridge is assembled, it thus forms a lipstick dispensing device.

The cartridge and the base are arranged in succession along a longitudinal axis of the lipstick dispensing device. In addition, the cartridge and the base are coupled and are rotatable, relative to each other, about an axis of rotation corresponding to the longitudinal axis of the lipstick dispensing device. Thus, by causing a rotation of the base relative to the cartridge, it is possible to move the receptacle for the stick of lipstick along the longitudinal axis of the dispensing device.

Usually, the base and the cartridge are permanently coupled. When the stick of lipstick is consumed, it is therefore necessary to buy a new dispensing device.

To overcome the above disadvantage, dispensing devices have therefore been produced in which the base and the cartridge are detachably coupled. When the stick of lipstick is consumed, it is thus possible to separate the base and the cartridge and to replace only the cartridge, which is more ecological. In addition, a user may possess a single base and several cartridges corresponding to sticks of lipstick of different colors.

However, it is then necessary to provide a specific assembly line for dispensing devices whose base and cartridge are reversibly coupled and a specific assembly line for dispensing devices whose base and cartridge are permanently or non-detachably coupled. This therefore has the disadvantage of complicating the manufacture of such devices.

OBJECT OF THE INVENTION

An object of the invention is to provide a cosmetic product dispensing assembly that is simpler to manufacture.

BRIEF DESCRIPTION OF THE INVENTION

To achieve this, the invention provides a cosmetic product dispensing assembly comprising:

a transmission element, a tubular cartridge of cosmetic product, configured to be detachably coupled to the transmission element, a receiving shell capable of receiving the transmission element, the cartridge comprising:

an outer tube comprising at least one helical groove, a control sleeve comprising at least one longitudinal guide slot, a receptacle for cosmetic product, engaging with the helical groove of the outer tube and the longitudinal guide slot of the control sleeve, a bottom element, integral in rotation with the control sleeve, characterized in that the transmission element is configured to be received and non-detachably held in the receiving shell, the receiving shell comprising a snap-in element on an inner face of the receiving shell.

Thus, the receiving shell for the transmission element can have a standard dimension and be capable of accepting a transmission element configured to be coupled reversibly or permanently to a complementary cartridge. As a result, it is possible to place on an assembly unit a series of receiving shells for the transmission element and to place therein a series of transmission elements configured to be coupled reversibly or permanently. The transmission element and the receiving shell therefore form, when assembled, a complementary base of the cartridge, whether the cartridge is intended to be detachably or permanently coupled to the base thus formed.

The standardization of the manufacture of the cosmetic product dispensing assembly is therefore increased. In addition, the transmission element has the function of transmitting a rotational movement, about a longitudinal axis of the cartridge, from the receiving shell to the bottom element and to the control sleeve, to enable a user to move the cosmetic product receptacle along the longitudinal axis of the cartridge.

In addition, in preferred embodiments of the invention, one or more of the following arrangements may possibly be used:

The snap-in element extends radially from the inner face of the receiving shell; the snap-in element is not visible from the outside and the receiving shell can thus have a very attractive external appearance;

The snap-in element comprises a snap-in tab or a snap-in ring; the receiving shell can thus be formed as one piece, for example by injection;

The snap-in element comprises a lip of generally triangular cross-section, the lip having an inclined upper face so as to form a ramp in a snap-in direction, a lower face of the lip being perpendicular to the snap-in direction; this forms a robust solution to prevent pulling apart;

Such a snap-fit between the receiving shell and the transmission element advantageously resists a tensile force of at least 30 Newtons in a direction opposite to the snap-in direction; once the initial snap-fit has been achieved, the retention is sufficient for all the various and varied tensile stresses which may occur during the life of the product, The transmission element comprises a portion having a cylindrical shape which comprises a groove capable of engaging with the snap-in element; it is thus possible to form the transmission element by injection;

The transmission element comprises a permanent magnet and the bottom element of the cartridge comprises a ring of ferromagnetic material so as to provide a magnetic retention force between the cartridge and the transmission element when the cartridge is coupled to the transmission element; the magnetic retention force is sufficiently high to avoid unwanted uncoupling of the cartridge, but it nevertheless remains below the retention force provided by the snap-fit of the transmission element inside the protective shell;

The outside diameter of the transmission element is substantially identical to the outside diameter of the coupling member of the control sleeve; it is thus possible to use the same tool to attach a conventional cartridge non-detachably on a base and also a cartridge of the abovementioned type detachably on a similar base.

The control sleeve has a first cylindrical portion and a second cylindrical portion arranged following the first cylindrical portion, the second cylindrical portion surrounding the bottom element, having a diameter greater than the diameter of the first cylindrical portion, and having a height equal to the height of the transmission element;

The cosmetic product receptacle comprises at least one guide stud which passes through the longitudinal guide slot of the control sleeve and which is arranged in the helical groove of the outer tube;

The guide stud is advantageously a pin;

The assembly comprises a cap intended to close off the tubular cartridge;

The receptacle for cosmetic product comprises a stick of lipstick;

The assembly comprises a stick of lipstick.

As an alternative to the snap-in element solution, according to another embodiment the transmission element is configured to be force-fitted into the receiving shell.

According to the invention, also provided is a method for assembling a cosmetic product dispensing assembly as described above, comprising at least the following steps:

the cartridge is coupled to the transmission element, and the transmission element coupled to the cartridge is arranged in the receiving shell by a relative movement between the receiving shell and the transmission element in a snap-in direction, the snap-in direction being a direction in which the receiving shell and transmission element draw relatively closer to one another.

Thus, as indicated above, it is possible to manufacture assemblies as defined above in which the cartridge and the transmission element can be detachably or non-detachably coupled on the same assembly line.

Also provided according to the invention is an assembled cosmetic product dispensing device comprising:

a transmission element, a tubular cartridge of cosmetic product, detachably coupled to the transmission element, a receiving shell capable of receiving the transmission element, the cartridge comprising:

an outer tube comprising at least one helical groove, a control sleeve comprising at least one longitudinal guide slot, a receptacle for cosmetic product, engaging with the helical groove of the outer tube and the longitudinal guide slot of the control sleeve, a bottom element, integral in rotation with the control sleeve, characterized in that the transmission element is received and non-detachably held in the receiving shell by a snap-in element (5C) on an inner face (5D) of the receiving shell.

The device thus corresponds to the assembly described above in which the members forming the assembly have been assembled. Of course, the device may have at least one of the features described above concerning the cosmetic product dispensing assembly.

According to the invention, there is also provided an assembly comprising a cartridge and a transmission element as defined above.

Finally, according to the invention, an assembly is provided comprising a transmission element and a receiving shell as described above.

BRIEF DESCRIPTION OF THE DRAWINGS

We will now describe an embodiment of the invention as a non-limiting example, with the aid of the following figures.

DETAILED DESCRIPTION OF AN EMBODIMENT OF THE INVENTION

For clarity, only the elements useful in understanding the described embodiments have been shown and will be detailed. It should be noted that in the figures, structural and/or functional elements common to the different embodiments have the same references. Thus, unless otherwise stated, such elements have identical structural, dimensional, and material properties. The scales of representation may vary from one figure to another.

Figure 1:
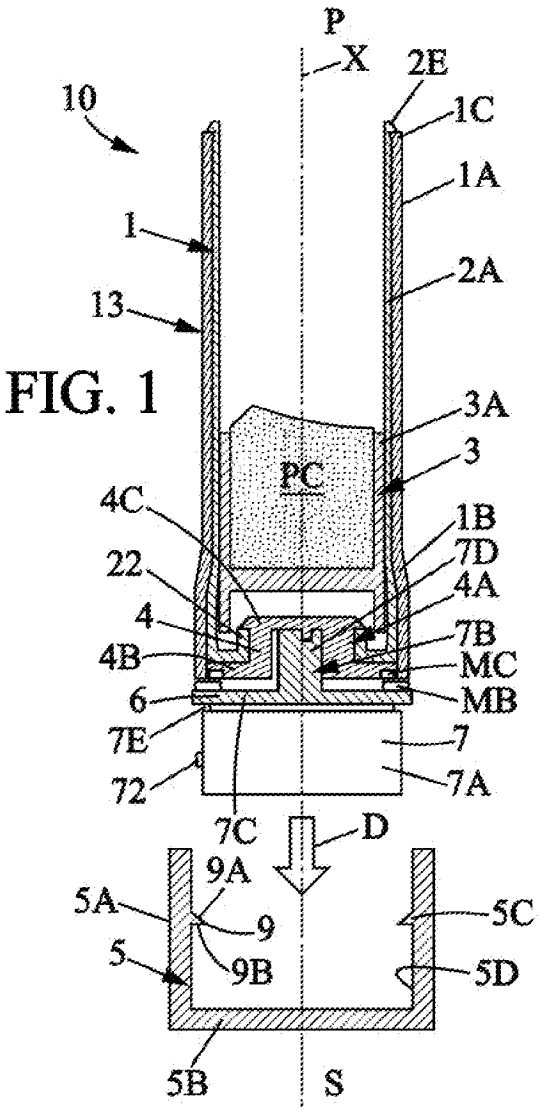
FIG. 1 illustrates a sectional view of a dispensing assembly in a plane comprising a longitudinal axis, according to one embodiment of the invention, which comprises a cartridge, a transmission element, and a receiving shell for the transmission element, and in which the transmission element has not yet been received in the receiving shell and the cartridge and transmission element are coupled.
Figure 2:
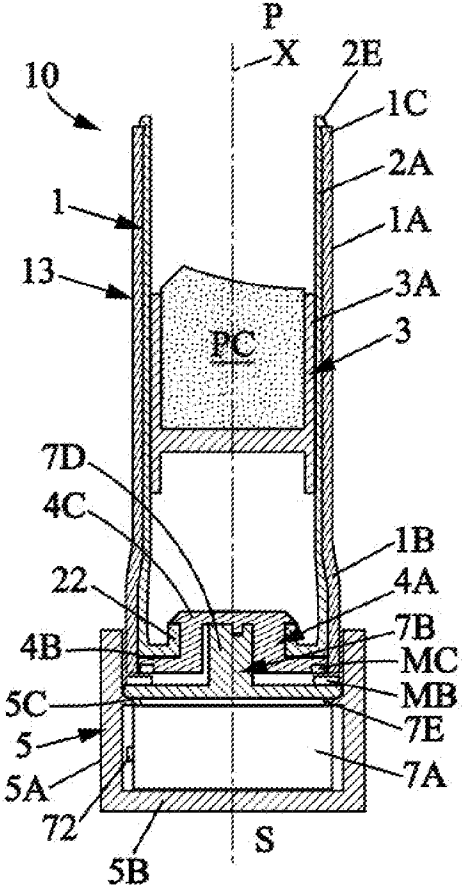
FIG. 2 illustrates this assembly in the same sectional plane, in which the transmission element has been received in the receiving shell and the transmission element and cartridge are coupled.
Figure 3:
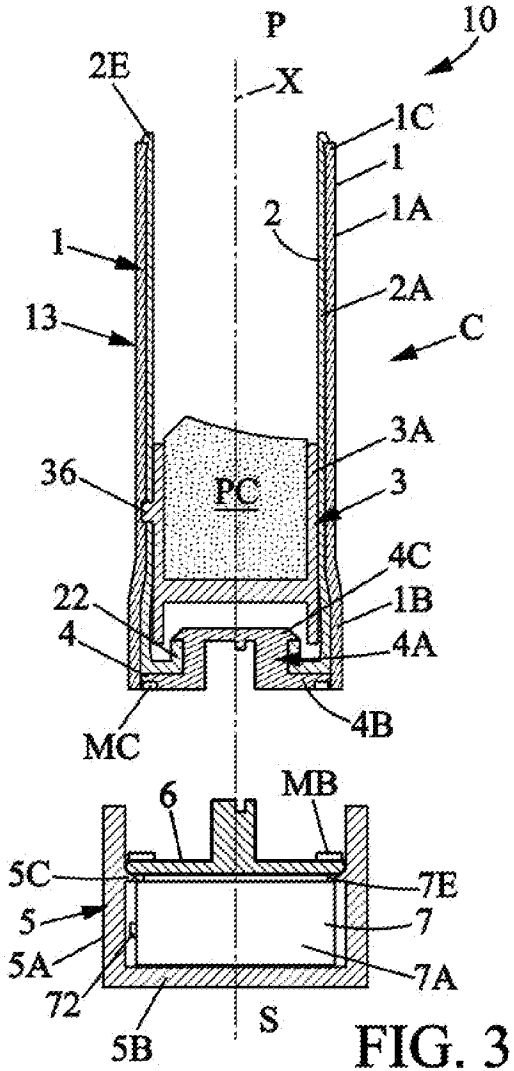
FIG. 3 represents this assembly, still in the sectional plane described above, in which the transmission element has been received in the receiving shell and the transmission element and cartridge are uncoupled.
Figure 5:
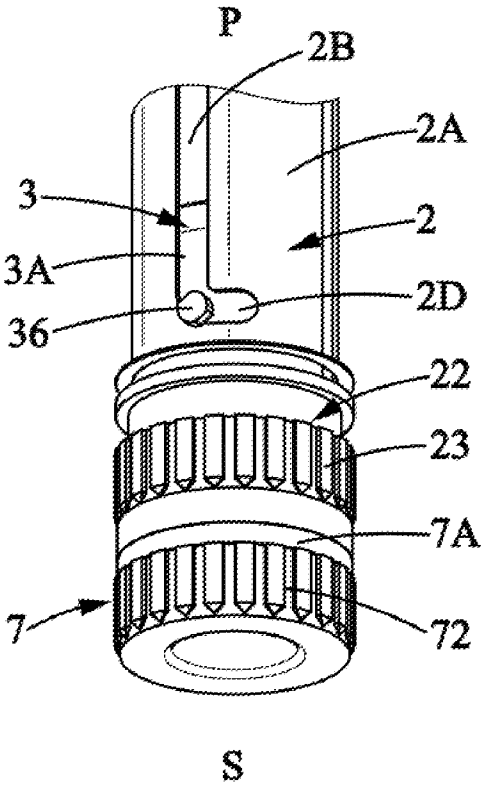
FIG. 5 represents a perspective view of the cartridge according to another embodiment, in which an outer tube has been removed and the transmission element is coupled.

Represented in FIGS. 1 to 3 is a cosmetic product dispensing assembly 10 according to the invention. The dispensing assembly 10, assembled, here forms a cosmetic product dispensing device 10. The cosmetic product dispensing device 10 according to the invention comprises a cartridge 13, a transmission element 7, and a receiving shell 5 capable of receiving the transmission element 7. The dispensing device 10 optionally comprises a cap which closes off access to the cartridge 13.

One will note that the cosmetic product dispensing assembly which comprises the cartridge 13, the transmission element 7, and the receiving shell 5 for the transmission element 7 in which these elements are not assembled is thus defined in the sense of the invention.

The dispensing device 10 is a lipstick case. It thus contains a stick of lipstick PC. The stick of lipstick PC is in the form of a solid or semi-solid material, in particular pasty, and is applied by rubbing it on the lips of a user.

In addition, the dispensing device 10 has a generally cylindrical shape and has a longitudinal axis X. It extends between a first longitudinal end P and a second longitudinal end S. The second longitudinal end S of the dispensing device 10 is the one furthest from the user's lips when the user is applying the stick PC to the lips. In the following description, reference will also be made to first P and second S longitudinal ends, defined as above, when describing members of the dispensing device 10. In addition, the adjectives "inner" and "outer" will be used in relation to the interior and exterior respectively of the dispensing device 10. In addition, a midplane is defined as being a plane perpendicular to the longitudinal axis X.

The transmission element 7 has a generally cylindrical shape. It comprises a main cylindrical body 7A and an operating member 7B, 6 resting on a face of the main body 7A and facing towards the cartridge 13 when the transmission element 7 and the cartridge 13 are detachably coupled. The operating member 7B has the function of enabling the detachable coupling of the transmission element 7 to the cartridge 13 as will be described in detail below. The operating member 7B also has the function of securing the transmission member 7 and the bottom element 4 to be integral in rotation.

The operating member 7B defines a three-dimensional coded pattern which is presented here in the shape of a key. It thus comprises a base 7C which extends in the midplane and which rests on the cylindrical wall 7A. The operating member 7B further comprises a coupling stud 7D which projects from the base 7C along the longitudinal axis X. The coupling stud 7D has a particular shape and contributes to giving the operating member 7B its key shape.

Figure 9:
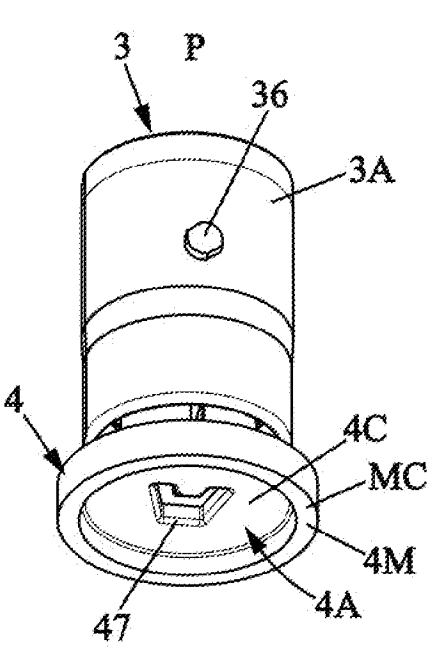
FIG. 9 illustrates a perspective view of a receptacle for a cosmetic product, the bottom element, and the transmission element for the dispensing device.
Figure 9:
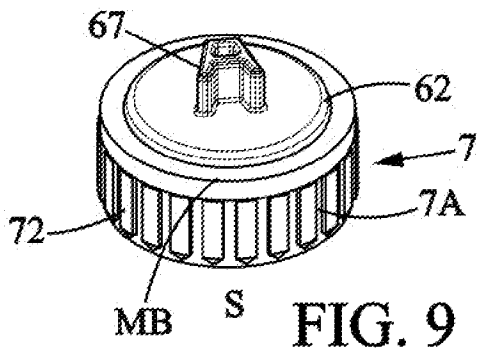

The coupling stud 7D bears the coded pattern defining a particular "A" shape 67, illustrated in FIG. 9, when viewed longitudinally from above. Of course, in some variants, the particular shape 67 may be any type of shape and in particular a "C", "S", "Z", or even "X" shape.

According to the invention, it is advantageous for the coded pattern to define a particular shape that can be easily identified by the user, for example a letter shape as indicated above. The user thus can easily identify that a certain transmission element 7 is suitable for coupling to a certain cartridge 13.

In addition, it will be noted that the base 7C has a slightly larger diameter than the cylindrical wall 7A. In addition, the cylindrical wall 7A has at its first longitudinal end P a smaller diameter than the diameter D72 of the rest of the cylindrical wall 7A. Thus, the base 7C and the cylindrical wall 7A define a generally cylindrical body which has a groove 7E corresponding to the first longitudinal end P of the cylindrical wall 7A. The function of the groove 7E will be described below.

The cylindrical wall 7A of the transmission element 7 also comprises, as illustrated schematically in FIGS. 1 to 3 and realistically in FIG. 9, a plurality of coupling grooves 72 arranged regularly on an outer radial face of the cylindrical wall 7A. The function of these coupling grooves 72 will also be described below.

In addition, the operating member 7B comprises, circumferentially on a radial edge of the base 7C, a permanently magnetized element which here is in the form of a magnet MB. The magnet MB has a general ring shape and extends circumferentially around the longitudinal axis X on the radial peripheral edge of the base 7C of the operating member 7B.

In this embodiment, the magnet MB essentially comprises iron, in particular in the form of ferrite, for example strontium ferrite or barium ferrite. In some variants, the magnet MB comprises an alloy of neodymium, iron, and boron, or an alloy of aluminum, nickel, and cobalt, or a polymer material which contains a powder comprising one of the materials or alloys described above.

The transmission element 7 may in particular be made of injected plastic. The cylindrical wall 7A and the operating member 7B may come as one piece or be formed separately and assembled by gluing for example.

The receiving shell 5 of the transmission element 7 has a cylindrical wall 5A which extends along the longitudinal axis X. In addition, the receiving shell 5 comprises a flat wall 5B which extends in the midplane. The flat wall 5B forms a bottom of the receiving shell 5. The flat wall 5B thus forms a second longitudinal end S of both the receiving shell 5 and the dispensing device 10 as illustrated in particular in FIG. 2.

In addition, the cylindrical wall 5A comprises, on an inner face 5D, a snap-in element 5C which extends radially towards the inside of the cylindrical wall 5A. This snap-in element 5C forms means for snap-fitting the transmission element 7 into the receiving shell 5. In the example of FIGS. 1 to 3, the snap-in element 5C is a snap-in ring. However, the snap-in element may not be continuous on the inner face 5D of the cylindrical wall 5A. A plurality of snap-in elements could thus be placed on the inner face 5D of the cylindrical wall 5A. They could be arranged in alignment along a circumference of the inner face 5D of the cylindrical wall 5A, or else not in alignment.

According to one embodiment, the snap-in element 5C further presents an adapted ramp shape to give the snap-in ring 5C a return-prevention function. Thus, according to one embodiment, the snap-in element 5C has the shape of a lip 9 of generally triangular cross-section. An upper face 9A of the lip 9 is inclined so as to form a ramp in a snap-in direction D. The snap-in direction D is a direction in which receiving shell 5 and the transmission element 7 can draw closer to one another. The upper face 9A therefore allows the snap-in element 5C to slide against the transmission element 7 during their assembly in the snap-in direction D. A lower face 9B of the lip 9 is perpendicular to the snap-in direction D. The lower face 9B therefore enables the snap-in element 5C to retain the transmission element 7 when the latter is assembled thereto, and does so in resistance to a relative movement of the receiving shell 5 and the transmission element 7 in a direction opposite to the snap-in direction D. It is possible for the lower face 9B of the snap-in element 5C to be at an angle not perpendicular to the snap-in direction D. The lower face 9B of the snap-in element 5C could for example be inclined in the same direction as the upper face 9A and thus provide resistance against movement of the transmission element 7 relative to the receiving shell 5 in the direction opposite to the snap-in direction D.

In some variants of the present embodiment, the cylindrical wall 5A comprises any type of snap-fitting means on the inner face 5D. These means may in particular comprise a snap-in element which may for example be a snap-in tab extending radially from the inner face 5D of the cylindrical wall 5A.

In addition, according to one embodiment the cylindrical wall 5A also comprises, on the inner face 5D, a plurality of coupling ribs (not shown) whose shape is complementary to that of the coupling grooves 72 of the transmission element 7.

In addition, the receiving shell 5 may have an exterior cross-section of circular, square, or even hexagonal shape.

According to the invention, the transmission element 7 is configured to be received and held permanently or non-detachably in the receiving shell 5.

To achieve this, as illustrated in particular in FIG. 2, the groove 7E is configured to engage with the snap-in ring 5C. More specifically, the groove 7E comprises a shoulder 79 on which the lower face 9B of the lip 9 comes to rest.

In addition, the coupling grooves 72 are configured to engage with the coupling ribs of the cylindrical wall 5A of the receiving shell 5. One will note that the engagement between the coupling grooves 72 and the coupling ribs also serve to secure the receiving shell 5 and the transmission element 7 so that they are integral in rotation about the longitudinal axis X.

In addition, regardless of the shape of the snap-in element 5C chosen, its resistance to movement of the transmission element 7 in the direction opposite to the snap-in direction D is preferably chosen to be greater than a coupling force between the magnet MB and a magnet MC of the bottom element 4. According to one embodiment, the snap-fit between the receiving shell 5 and the transmission element 7 resists a tensile force of at least 30 Newtons in a direction opposite to the snap-in direction D.

According to a variant of this embodiment, the transmission element 7 is configured to be force-fitted into the receiving shell 5. To do this, the diameter D72 of the cylindrical wall 7A of the transmission element 7 is a few millimeters larger than the inside diameter of the cylindrical wall 5A of the receiving shell 5.

Thus, when the receiving shell 5 receives and non-detachably holds the transmission element 7, the receiving shell 5 and the transmission element 7 form a base 8 for the cartridge 13.

Furthermore, the cartridge 13 comprises an outer tube 1, a control sleeve 2, a receptacle 3 for the stick of lipstick PC, and a bottom element 4.

Figure 7:
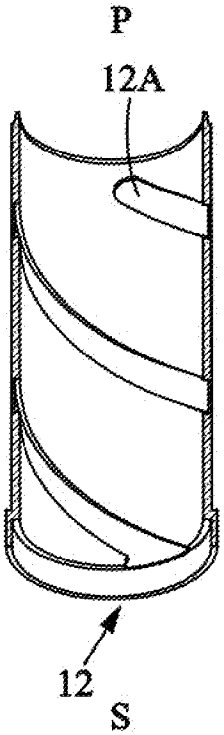
FIG. 7 represents a sectional view of a technical part for the outer tube.
Figure 6:
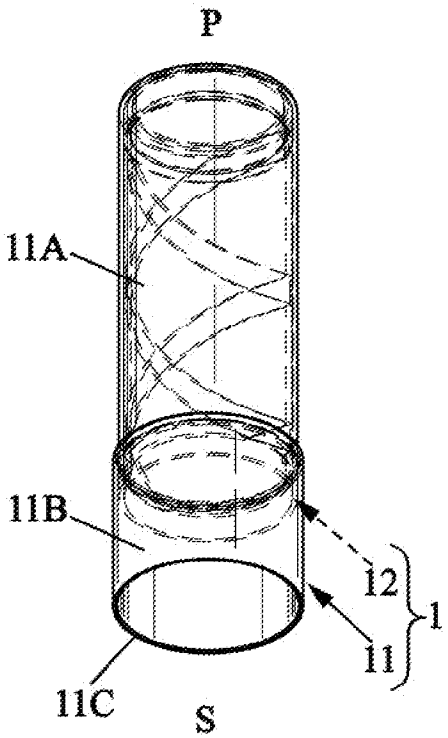
FIG. 6 illustrates a perspective view of a covering part for the outer tube of the cartridge.

The outer tube 1, also illustrated in FIGS. 6 and 7, has the function of forming an outer cylindrical wall for the cartridge 13. The outer tube 1 has a generally cylindrical shape of axis X. It has a first longitudinal end P intended to allow access to the stick of lipstick PC and an opposite second longitudinal end S. The first longitudinal end P of the outer tube 1 also forms a first longitudinal end P for the cartridge 13. In addition, the outer tube 1 extends substantially along the entire height of the cartridge 13. It thus forms a protective sheath for the cartridge 13.

As illustrated in FIGS. 6 and 7, the outer tube 1 comprises a covering part 11 which surrounds a technical part 12. The covering part 11 gives the outer tube 1 adequate structural reinforcement. The technical part 12 comprises, on an inner cylindrical face, two helical grooves 12A which extend along the longitudinal axis X of the cartridge 13. These two helical grooves 12A are arranged opposite one another. They are thus diametrically opposed.

In addition, the outer tube 1 has a first cylindrical portion 1A and a second cylindrical portion 1B arranged following the first cylindrical portion 1A. The first cylindrical portion 1A is closer to the first longitudinal end P of the cartridge 13 than the second cylindrical portion 1B. The second cylindrical portion 1B has a diameter greater than the diameter of the first cylindrical portion 1A, for example 17 mm and 16 mm respectively for the outside diameters.

Thus, the cartridge 13 also has a first cylindrical portion and a second cylindrical portion arranged following the first cylindrical portion. The second cylindrical portion has a diameter greater than the diameter of the first cylindrical portion and surrounds the bottom element 4 as illustrated in FIGS. 1 to 3.

Similarly, the covering part 11 has a first cylindrical portion 11A and a second cylindrical portion 11B arranged following the first cylindrical portion 11A. The first cylindrical portion 11A is closer to the first longitudinal end P of the outer tube 1 than the second cylindrical portion 11B. The second cylindrical portion 11B has a diameter greater than the diameter of the first cylindrical portion 11A. One will note that the lower edge 11C of the outer tube forms an integral radial protection for the bottom element (skirt function). In other words, the lower edge 11C extends down to the bottom and forms the overall lengthwise dimension of the cartridge. For the assembly, the technical part 12 is inserted into the covering part 11 from below, until it abuts against the inside shoulder (see FIG. 6).

The covering part 11 and the technical part 12 may be formed of metal or of injected plastic. They may be fixed to each other by gluing. The covering part 11 and the technical part 12 may also come as one piece.

In addition, the outer tube 1 comprises, at its first longitudinal end P, a circumferential coupling edge 1C whose function will be described below.

Figure 8:
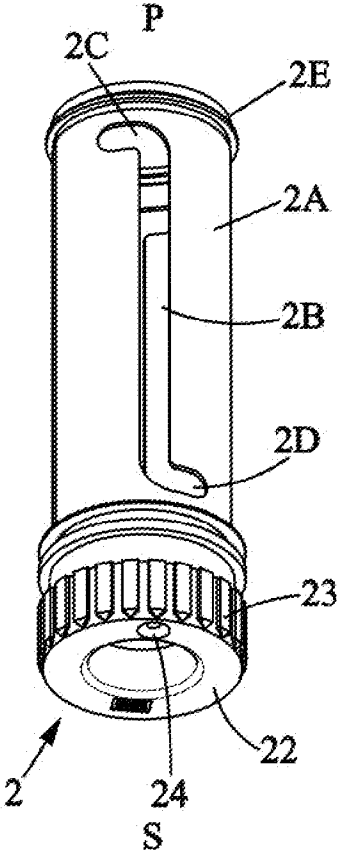
FIG. 8 illustrates a perspective view of the control sleeve for the cartridge.

The control sleeve 2 also has a generally cylindrical shape. It is arranged against the inner cylindrical walls of the outer tube 1. As illustrated in FIG. 8, the control sleeve 2 comprises a main body 2A of regular generally cylindrical shape. On this main body 2A, the control sleeve 2 comprises two longitudinal guide slots 2B that are diametrically opposite through-slots. Each longitudinal guide slot 2B extends parallel to the longitudinal axis X. At its first P and second S longitudinal ends, each longitudinal guide slot 2B extends perpendicularly to the axis (X) for a small distance relative to its longitudinal dimension, so as to define two end-of-travel positions 2C, 2D for the receptacle 3 as will be described below. End-of-travel position 2C is relatively closer to the first longitudinal end P of the cartridge than end-of-travel position 2D.

In addition, on the radial periphery of its first longitudinal end P, the main body 2A comprises a flange 2E. The function of the flange 2E will be described below.

In addition, the control sleeve 2 comprises a coupling member 22 arranged following the main body 2A, forming a second longitudinal end S of the control sleeve 2.

One will note that the coupling member 22 can be used to couple the control sleeve 2 to a base for a dispensing device in which the base and the cartridge are non-detachably coupled. To do this, the coupling member 22 comprises a cylindrical wall comprising a plurality of coupling grooves 23.

In addition, the coupling member 22 comprises an orifice 24, on a wall facing the base when the base and the cartridge are coupled, due to the fact that the control sleeve 2 is preferably formed by injection of a plastic material.

In the case of the present invention, the outer tube 1 and in particular the second cylindrical portion 11B of the covering part 11 surrounds this coupling member 22. Thus, advantageously, the dispensing device 10 according to the invention can be implemented with a control sleeve 2 that is also suitable for a dispensing device 10 in which the base and the cartridge are non-detachably coupled. In addition, the coupling member also serves to couple the control sleeve 2 to the bottom element 4.

Figure 10:
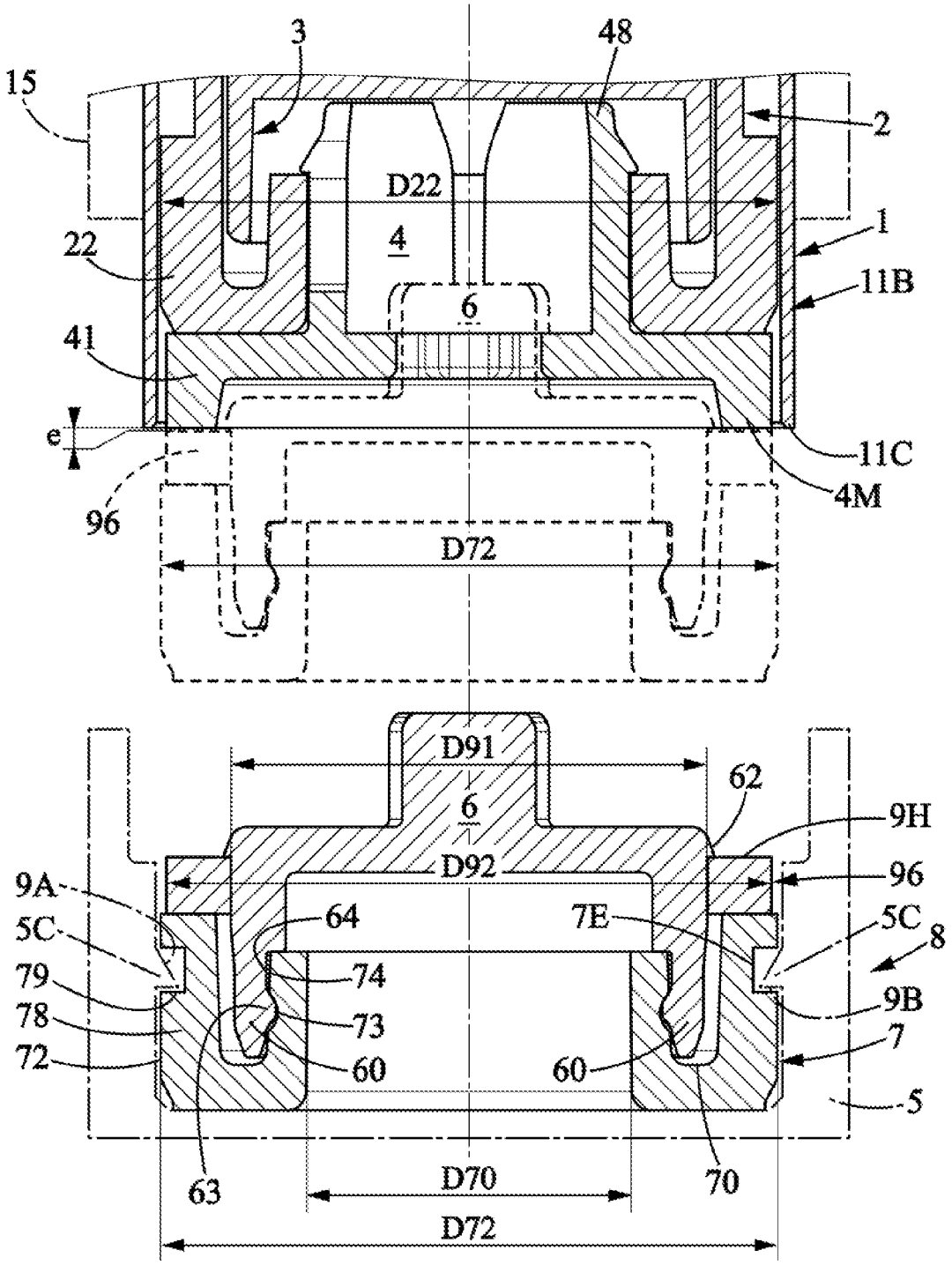
FIG. 10 illustrates more particularly the magnetic retention interface between the base and the cartridge, according to an alternative embodiment.

The receptacle 3 for the stick of lipstick PC here is in the form of a receiving cup. In addition, it comprises a main body 3A of regular generally cylindrical shape, in other words of constant diameter along the longitudinal axis X. As illustrated in FIG. 10, the receptacle 3 comprises, on an outer face of the main body 3A, two guide studs 36 which are diametrically opposite and which extend radially outward from the receptacle 3. The function of the two guide studs 36 will be described below. The receptacle 3 also preferably comprises injected plastic.

The bottom element 4 extends mainly in the midplane. It comprises a complementary operating member 4A. The complementary operating member 4A comprises a complementary coded pattern which here has the shape of a lock.

The complementary operating member 4A comprises a first flat circumferential portion 4B which forms a longitudinal stop for operating member 7B as will be described in more detail below. The first flat portion 4B extends in the midplane.

The complementary operating member 4A comprises a second flat portion 4C which extends at a distance from flat portion 4B. The second flat portion 4C also extends in the midplane. The second flat portion 4C is closer to the first longitudinal end P of the cartridge 13 than the first flat portion 4B. In addition, the first flat portion 4B is further from the longitudinal axis X than the second flat portion 4C which intersects this longitudinal axis X.

The second flat portion 4C bears the complementary coded pattern which has a particular shape 47 and contributes to giving the complementary operating member the lock shape. This particular shape 47 represents an "A", as illustrated in FIG. 9, when viewed longitudinally from above. Of course, alternatively the particular shape 47 can have any type of shape and in particular a "C", "S", "Z" or even "X" shape.

In addition, as illustrated in FIGS. 1 to 4, the bottom element 4 is solid and thus closes off access to inside the cartridge 13 through the second longitudinal end S of the cartridge 13.

In addition, the first flat portion 4B and the second flat portion 4C are shaped to sandwich a portion of the coupling member 22 of the control sleeve 2.

According to the embodiments shown, the first means for coupling to the base 8 comprise a radial peripheral rim 4M of the bottom element 4.

In the examples illustrated in FIGS. 8 to 10, the radial peripheral rim 4M forms a magnetic coupling means and for this purpose is loaded with ferrites, in other words more generally a ferromagnetic material capable of being magnetized in an induced manner under the effect of an incident magnetic field.

More specifically, the ferromagnetic material is a material having a passive magnetic property, in other words a material which does not induce a permanent magnetic field under normal conditions but which is attracted by a magnet.

For example, particles of such a ferromagnetic material may be inserted into the plastic substrate to be molded.

For example, the plastic substrate to be molded is a thermoplastic material, such as polypropylene (PP), polyethylene terephthalate (PET), polyvinyl chloride (PVC), or any other polymer suitable for molding and/or injection. The passive magnetic particles may be, for example, iron particles, ferrite particles, or passivated ferric oxide particles.

According to an alternative solution illustrated in FIGS. 1 to 3, the first flat portion 4B comprises a permanently magnetized element which here is in the form of a magnet MC. The magnet MC has a general ring shape and extends circumferentially around the longitudinal axis X on a face of the first flat portion 4B facing the base 7C of the transmission element 7, when the transmission element 7 and the cartridge 13 are coupled as will be described below. In this embodiment, the magnet MC essentially comprises iron, particularly in the form of ferrite, for example strontium ferrite or barium ferrite. According to some variants, the magnet MC comprises an alloy of neodymium, iron, and boron, or an alloy of aluminum, nickel, and cobalt, or a polymeric material which contains a powder comprising one of the materials or alloys described above. According to some variants, the magnet MC may be a part of ferromagnetic material which is magnetized by an incident magnetic field.

The magnet or ring made of ferromagnetic material MC is arranged on a face of the bottom element 4 facing the flat wall 5B of the base 8 when the base 8 and the cartridge 13 are coupled.

At this location, the air gap in the coupled position will be less than 0.5 mm and preferably less than 0.2 mm. Knowing that the force of attraction between two elements under the action of a magnetic field decreases with the cube of the air gap distance, we will seek to obtain as small a space as possible and in practice we will seek to have the ring of ferromagnetic material NC directly in contact with the magnet 96, as shown in phantom lines in FIG. 10.

In addition, the outer tube 1 radially surrounds and extends longitudinally over the entire height of the bottom element 4. In the current case, the second cylindrical portion of the cartridge 13 comprises the bottom element 4. In addition, a radial edge of the bottom element 4 is in direct contact with a radially inner face of the outer tube 1. Thus, as can be seen in particular in FIGS. 1 to 3, the bottom element 4 forms, with the outer tube 1, the second longitudinal end S of the cartridge 13.

One will note that according to an advantageous variant, the bottom element 4 is arranged at a distance from and set back from the second longitudinal end S of the cartridge 13. The bottom element 4 is thus arranged between and at a distance from the first P and second S longitudinal ends of the outer tube 1. This prevents manipulation of the bottom element 4 when the cartridge 13 is not coupled to the transmission element 7.

As indicated above, the transmission element 7 and the cartridge 13 are effectively configured to be detachably coupled.

To achieve this, as illustrated in FIGS. 1 to 3, the magnet MB of the transmission element 7 and the magnet MC of the bottom element 4 are arranged facing one another when the transmission element 7 and cartridge 13 are detachably coupled. In addition, their facing sides have opposite polarities. They thus cooperate and generate a force that detachably couples the transmission element 7 and the cartridge 13.

In addition, the key-shaped operating member 7B is capable of being engaged in the complementary lock-shaped operating member 4A of the bottom element 4. This engagement also contributes to securing the transmission element 7 and the bottom element 4 so that they are integral in rotation about the longitudinal axis X.

The cartridge 13 is thus also detachably coupled, via the transmission element 7, to the receiving shell 5. In addition, the receiving shell 5 and the cartridge are thus secured so that they are integral in rotation about the longitudinal axis X.

We will now describe an operation of the dispensing device 10, in particular to access the stick of lipstick PC. Below we will describe in particular the movements of the members of the cartridge 13 with respect to each other.

The flange 2E of the control sleeve 2 has the function of engaging with the circumferential coupling edge 1C of the outer tube 1 as illustrated in FIGS. 1 to 3, in order to lock the control sleeve 2 in translation along the longitudinal axis X relative to the outer tube 1. In addition, the control sleeve 2 is rotatable about the longitudinal axis X relative to the outer tube 1.

The bottom element 4 is integral in rotation about the longitudinal axis X with respect to the control sleeve 2. This property of being integral in rotation is in particular due to the engagement between the coupling member 22 of the control sleeve 2 and the first 4B and second 4C flat portions of the bottom element 4. Thus, when the transmission element 7 and the cartridge 13 are detachably coupled, the transmission element 7 and the control sleeve 2 are integral in rotation about the longitudinal axis X.

In addition, the receptacle 3 engages with the helical groove 12A of the outer tube 1 and the longitudinal guide slot 2B of the control sleeve 2. To achieve this, each of the two guide studs 36 of the receptacle 3 engages with one of the two longitudinal guide slots 2B of the control sleeve 2 and traverses said slot. The receptacle 3 is thus movable in longitudinal translation relative to the control sleeve 2, between the two end-of-travel positions 2C and 2D for the guide stud 36. In addition, each guide stud 36 engages with one of the two helical grooves 12A of the outer tube 1 when arranged within said groove. The receptacle 3 is thus movable in rotation about the axis X and in longitudinal translation relative to the outer tube 1.

When the control sleeve 2 begins to rotate relative to the outer tube 1 with respect to the longitudinal axis X, each guide stud 36 of the receptacle 3 thus moves along a helical groove 12A and a longitudinal groove 2B. The receptacle 3 thus begins to rotate about the longitudinal axis X and to move in longitudinal translation relative to the outer tube 1.

Thus, when the user wishes to move the receptacle 3 longitudinally relative to the outer tube 1, for example to cause the stick of lipstick PC to project beyond the first longitudinal end P of the outer tube 1, he or she locks the outer tube 1 against longitudinal translation and rotation about the longitudinal axis X. Next, he or she imparts a rotational movement to the receiving shell 5, about the longitudinal axis X relative to the outer tube 1. The transmission member 7 transmits this rotational movement to the bottom element 4. The bottom element 4 and the control sleeve 2 thus begin to rotate about the longitudinal axis X relative to the outer tube 1. Each guide stud 36 of the receptacle 3 will then move along a helical groove 12A and a longitudinal guide slot 2B. The receptacle 3 thus moves longitudinally along the cartridge 13. It can therefore be seen that a relative rotation of the receiving shell 5 with respect to the cartridge 13 causes the receptacle 3 for the stick of lipstick PC to move with respect to the outer tube 1 along the longitudinal axis X of the cartridge 13.

Figure 4:
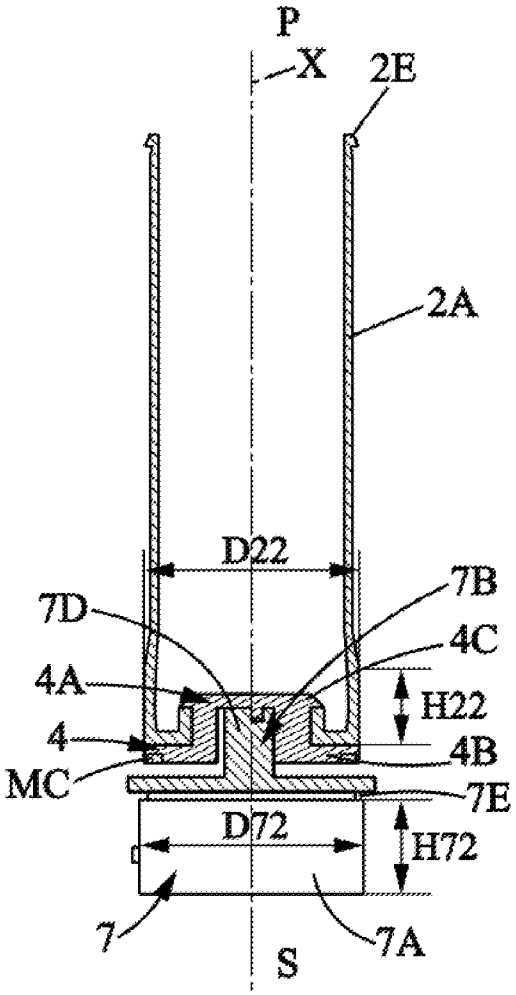
FIG. 4 illustrates the transmission element, a bottom element, and a control sleeve of the cartridge coupled to the transmission element.

In addition, as illustrated in FIG. 4, the coupling member 22 of the control sleeve 2 advantageously has a height H22 substantially equal to the height H72 of the cylindrical wall 7A of the transmission element 7. Furthermore, the coupling member 22 has a diameter D22 which is substantially equal to the diameter D72 of the cylindrical wall 7A. In addition, the outer tube 1 preferably has a diameter substantially equal to the diameter of the base 7C of the transmission element 7.

We will now describe a method for manufacturing the dispensing device 10.

The receiving shell 5, the transmission element 7, and the cartridge 13 are formed separately.

The receiving shell 5 and the transmission element 7 are preferably formed by injection of a plastic material. To form the cartridge 13, the outer tube 1, the control sleeve 2, the receptacle 3, and the bottom element 4 are formed separately, for example by injection. Then these members are assembled to form the cartridge 13.

Next, the transmission element 7 is placed in the receiving shell 5 so that the transmission element 7 is received and permanently or non-detachably held in the receiving shell 5.

Then the cartridge 13 is detachably coupled to the transmission element 7.

Alternatively, the cartridge 13 is first detachably coupled to the transmission element 7.

Next, the transmission element 7, coupled to the cartridge 13, is placed in the receiving shell 5 so that the transmission element 7 is received and permanently or non-detachably held in the receiving shell. 5.

Of course, many variations can be made to the invention without departing from the scope thereof.

The transmission element 7 may in particular comprise means for direct coupling to the control sleeve 2.

The bottom element 4 may also comprise at least one aperture so that the bottom element 4 does not close off access to inside the cartridge 13 through the second longitudinal end S.

In FIG. 10, the magnet MB is an annular magnet denoted 96 held in place by snap-fitting two plastic parts 6,7. In a typical example, the outside diameter D92 of the annular magnet 96 is 16 mm. In a typical example, the inside diameter D91 of the annular magnet 96 is 12 mm. The thickness of the annular magnet 96 is between 1 mm and 2 mm.

According to a variant third embodiment, with particular reference to FIG. 10, the magnetic and mechanical interface between the base and the cartridge is shown in more detail in an uncoupled configuration (solid lines) and in a coupled configuration (dotted lines). The coupling element 6 is associated with a transmission element 7 in order to attach a permanent magnet 96 by snap-fitting. The transmission element 7 comprises an annular groove 70 which opens upwards and is designed to receive snap-fitting tabs 60 projecting downwards from the coupling element 6. The transmission element 7 may be glued or fixed to the protective shell 5. The outer rim 78 of the base element comprises ribs 72 engaged in the protective shell 5 in order to integrally secure it at least in rotation.

The snap-fitting tabs 60 comprise a bead 63 and an annular groove 64. The bead 63 is received in a complementary annular groove 73 of the transmission element 7. The annular groove 64 receives a complementary bead 74 of the transmission element 7. This forms a solid and durable snap-fit.

Advantageously, a reliable and durable assembly is thus formed without the use of glue.

In addition, an upper annular edge 62 is provided which forms a shoulder to hold the magnet 96 in position against the outer rim 78 of the transmission element 7. The upper annular edge 62 may be continuous or discontinuous in the circumferential direction.

The outside diameter D72 of the base element is preferably within the range of values [15 mm-17 mm]. One will note that this diameter D72 is preferably advantageously identical to the diameter D22 of the coupling member of the control sleeve, which makes it possible to optimize the assembly means.

The inside diameter D70 of the base element is preferably within the range of values [8 mm-12 mm].

If we consider the air gap denoted e which separates the upper surface 9B of the permanent magnet and the lower surface of the ferrite ring 4B of the bottom element, in the coupled configuration this is preferably less than 0.5 mm, or even close to zero.

In the example of FIG. 10, the rotational driving of the bottom element 4 by the coupling element 6 is obtained by the total or partial complementarity of the three-dimensional coded patterns coupled together.

The base 8 and the cap 15 (FIG. 10 in phantom lines) together form a case provided to enhance the appearance of the cosmetic product dispensing device. The base and the cap may in particular have a highly aesthetic decoration, or even a decoration providing luxury customization.

The invention claimed is:

1. Cosmetic product (PC) dispensing assembly (10) comprising:

a transmission element (7), a tubular cartridge (13) of cosmetic product (PC), configured to be detachably coupled to the transmission element (7), a receiving shell (5) capable of receiving the transmission element (7), the cartridge (13) comprising:

an outer tube (1) comprising at least one helical groove (12A), a control sleeve (2) comprising at least one longitudinal guide slot (2B), a receptacle (3) for cosmetic product (PC), engaging with the helical groove (12A) of the outer tube (1) and the longitudinal guide slot (2B) of the control sleeve (2), a bottom element (4), integral in rotation with the control sleeve (2), wherein the transmission element (7) is configured to be received and non-detachably held in the receiving shell (5), the receiving shell (5) comprising a snap-in element (5C) on an inner face (5D) of the receiving shell (5).

2. The cosmetic product dispensing assembly (10) according to claim 1, wherein the snap-in element (5C) extends radially from the inner face of the receiving shell.

3. The cosmetic product dispensing assembly (10) according to claim 2, wherein the snap-in element comprises one or more snap-in tab(s) or a snap-in ring.

4. The cosmetic product dispensing assembly (10) according to claim 2, wherein the snap-in element comprises a lip (9) of generally triangular cross-section, the lip having an inclined upper face (9A) so as to form a ramp in a snap-in direction (D), a lower face (9B) of the lip being perpendicular to the snap-in direction.

5. The cosmetic product dispensing assembly (10) according to claim 2, wherein a snap-fit between the receiving shell (5) and the transmission element (7) resists a tensile force of at least 30 Newtons in a direction opposite to the snap-in direction (D).

6. The cosmetic product dispensing assembly (10) according to claim 2, wherein a permanent magnet (96, MB) is provided on the transmission element (7) and the bottom element (4) of the cartridge comprises a ring of ferromagnetic material (4M) so as to provide a retention force between the cartridge and the transmission element (7) when the cartridge is coupled to the transmission element (7).

7. The cosmetic product dispensing assembly (10) according to claim 1, wherein the snap-in element comprises one or more snap-in tab(s) or a snap-in ring.

8. The cosmetic product dispensing assembly (10) according to claim 7, wherein the transmission element (7) comprises a portion having a cylindrical shape which comprises a groove (7E) capable of engaging with the snap-in element.

9. The cosmetic product dispensing assembly (10) according to claim 7, wherein the snap-in element comprises a lip (9) of generally triangular cross-section, the lip having an inclined upper face (9A) so as to form a ramp in a snap-in direction (D), a lower face (9B) of the lip being perpendicular to the snap-in direction.

10. The cosmetic product dispensing assembly (10) according to claim 7, wherein a snap-fit between the receiving shell (5) and the transmission element (7) resists a tensile force of at least 30 Newtons in a direction opposite to the snap-in direction (D).

11. The cosmetic product dispensing assembly (10) according to claim 7, wherein a permanent magnet (96, MB) is provided on the transmission element (7) and the bottom element (4) of the cartridge comprises a ring of ferromagnetic material (4M) so as to provide a retention force between the cartridge and the transmission element (7) when the cartridge is coupled to the transmission element (7).

12. The cosmetic product dispensing assembly (10) according to claim 1, wherein the snap-in element comprises a lip (9) of generally triangular cross-section, the lip having an inclined upper face (9A) so as to form a ramp in a snap-in direction (D), a lower face (9B) of the lip being perpendicular to the snap-in direction.

13. The cosmetic product dispensing assembly (10) according to claim 12, wherein a snap-fit between the receiving shell (5) and the transmission element (7) resists a tensile force of at least 30 Newtons in a direction opposite to the snap-in direction (D).

14. The cosmetic product dispensing assembly (10) according to claim 12, wherein the transmission element (7) comprises a portion having a cylindrical shape which comprises a groove (7E) capable of engaging with the snap-in element.

15. The cosmetic product dispensing assembly (10) according to claim 1, wherein a snap-fit between the receiving shell (5) and the transmission element (7) resists a tensile force of at least 30 Newtons in a direction opposite to the snap-in direction (D).

16. The cosmetic product dispensing assembly (10) according to claim 1, wherein a permanent magnet (96, MB) is provided on the transmission element (7) and the bottom element (4) of the cartridge comprises a ring of ferromagnetic material (4M) so as to provide a retention force between the cartridge and the transmission element (7) when the cartridge is coupled to the transmission element (7).

17. The cosmetic product dispensing assembly (10) according to claim 1, wherein an outside diameter (D72) of the transmission element (7) is substantially identical to an outside diameter (D22) of a coupling member (22) of the control sleeve (2).

18. The cosmetic product dispensing assembly (10) according to claim 1, wherein the receptacle (3) for cosmetic product comprises a stick of lipstick.

19. Method for assembling a cosmetic product dispensing assembly (10) according to claim 1, comprising at least the following steps:

the cartridge is coupled to the transmission element, and the transmission element coupled to the cartridge is arranged in the receiving shell by a relative movement between the receiving shell and the transmission element in a snap-in direction (D), the snap-in direction being a direction in which the receiving shell and the transmission element draw relatively closer to one another.

20. Cosmetic product (PC) dispensing device (10) comprising:

a transmission element (7), a tubular cartridge (13) of cosmetic product (PC), detachably coupled to the transmission element (7), a receiving shell (5) capable of receiving the transmission element (7), the cartridge (13) comprising:

an outer tube (1) comprising at least one helical groove (12A), a control sleeve (2) comprising at least one longitudinal guide slot (2B), a receptacle (3) for cosmetic product (PC), engaging with the helical groove (12A) of the outer tube (1) and the longitudinal guide slot (2B) of the control sleeve (2), a bottom element (4), integral in rotation with the control sleeve (2), wherein the transmission element (7) is received and non-detachably held in the receiving shell (5) by a snap-in element (5C) on an inner face (5D) of the receiving shell (5).

* * * * *